US007109431B2

(12) United States Patent
Yanai et al.

(10) Patent No.: US 7,109,431 B2
(45) Date of Patent: Sep. 19, 2006

(54) PUSH-ON SWITCH

(75) Inventors: Yasunori Yanai, Okayama (JP); Hisashi Watanabe, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/250,547

(22) Filed: Oct. 17, 2005

(65) Prior Publication Data

US 2006/0081452 A1 Apr. 20, 2006

(30) Foreign Application Priority Data

Oct. 20, 2004 (JP) ..... 2004-305476

(51) Int. Cl.
*H01H 1/10* (2006.01)

(52) U.S. Cl. ..... 200/512; 200/341

(58) Field of Classification Search ..... 200/512–517, 200/341–345, 5 A

See application file for complete search history.

(56) References Cited

U.S. PATENT DOCUMENTS 5,499,041 A * 3/1996 Brandenburg et al. ..... 345/174
5,664,667 A * 9/1997 Kenmochi ..... 200/314
6,388,218 B1 * 5/2002 Ando et al. ..... 200/512
6,501,036 B1 * 12/2002 Rochon et al. ..... 200/302.2

FOREIGN PATENT DOCUMENTS

JP 2002-343178 11/2002

* cited by examiner

*Primary Examiner*—K. Lee
(74) *Attorney, Agent, or Firm*—Weneroth, Lind & Ponack, L.L.P.

(57) ABSTRACT

A push-on switch according to the present invention is constructed so that a pressing part faces the top surface of a dome-shaped movable contact, across a given clearance. Such a construction allows the pressing part to be pressed a distance until the pressing part touches the movable contact to be utilized for pre-loading, even if the movable contact has a short operation stroke.

8 Claims, 5 Drawing Sheets

PUSH-ON SWITCH

BACKGROUND OF THE INVENTION

1. Field of the Invention

The present invention relates to a push-on switch that is used as an operating switch for an input operation unit in an electric apparatus including an electric component such as a car air-conditioner, and audiovisual equipment.

2. Background Art

In recent years, a push-on switch has been widely used as an operating switch for an input operation unit in an electric apparatus including a car air-conditioner and audiovisual equipment. A description will be made for such a conventional push-on switch, using FIG. 7.

FIG. 7 is a sectional view of the conventional push-on switch. In FIG. 7, case 1 is a case made of insulating resin, open at its top. Fixed contact 2 (2A and 2B), made of a pair of metal plates, is insert-molded to be fixed to the central part of inner bottom surface 1A of case 1.

The bottom end of movable contact 3, made of an elastic thin metal plate, formed in a dome shape, and open at its bottom, is placed on fixed contact 2B disposed at the outer position. In this case, the bottom surface of movable contact 3 maintains a clearance of the height of the dome from fixed contact 2A at the central position that corresponds to the position below the central top of movable contact 3.

Power driver 4, made of rigid material, is placed movably up and down on the central top of the above-mentioned movable contact 3. This power driver 4 is composed of flange 4A, annularly formed at the position of an intermediate height; lower pressing part 4B, with a small diameter, projectingly formed on the bottom surface of flange 4A; and operating projection 4C, projectingly formed on the top surface of lower pressing part 4B. The bottom surface of the above-mentioned lower pressing part 4B touches the central top of the above-mentioned movable contact 3.

Meanwhile, operating projection 4C of power driver 4 projects upward through a through-hole disposed on cover 5. The cover 5 is combined with case 1 so as to cover the opening of case 1, where the top surface of flange 4A of power driver 4 touches the bottom surface of cover 5 in a non-operational state.

The conventional push-on switch with the structure as mentioned above is mounted to a cabinet or the like so that a pressing operation can be performed with set knob 7, which is an operation button in the electric apparatus, disposed movably up and down, as shown in FIG. 7.

When operating projection 4C of power driver 4 is pressed through the above-mentioned set knob 7, the central top of movable contact 3 is immediately pressed by lower pressing part 4B provided on the bottom of power driver 4, and then a given force causes movable contact 3 to invert at its central part with comfortableness (i.e., with a comfortable feeling to the operator). Consequently, the bottom surface of movable contact 3 touches centrally-disposed fixed contact 2A; and then externally-located fixed contact 2B short-circuits with centrally-located fixed contact 2A through movable contact 3, to enter a switch-on state.

Movable contact 3, when pressing of power driver 4 is stopped, returns to its original, upwardly convex dome shape, with comfortableness, owing to its own restorative force, to separate from centrally-positioned fixed contact 2A. Then, power driver 4 is pressed back upward according to the restorative action, to enter the original switch-off state shown in FIG. 7.

Here, information on prior art documents related to the present invention includes Japanese Patent Unexamined Publication No. 2002-343178.

However, in the above-mentioned conventional push-on switch, small dimensional tolerance is required for the parts of the electric apparatus in order to incorporate set knob 7 for pressing down power driver 4, without rattle.

SUMMARY OF THE INVENTION

An object of the present invention is, in order to solve such a conventional problem, to provide a push-on switch that allows combination with a set knob with a given pre-load and suppresses rattle and the like of the set knob.

In order to achieve the above-mentioned object, a push-on switch according to the present invention includes a case made of insulating resin, provided with a plurality of electrically independent fixed contacts on the bottom surface of the recess of the case with its top open; a movable contact, made of a metal plate, formed in a dome shape, that inverts with comfortableness to cause or break electrical connection of the fixed contacts with one another; an elastic body contained in the recess of the case, equipped with a pressing part positioned above the movable contact across a given distance, the pressing part bending due to a pressing operation without comfortableness, to move up and down; and a cover mounted on the case so as to cover the top surface of the recess of the case.

Such a makeup allows this elastic body to be combined with the set knob with a given pre-load applied to the elastic body, using a dome-shaped movable contact with a short operation stroke, in an initial press-down distance, which refers to a distance from when the elastic body starts bending without comfortableness until the pressing part contacts the top surface of the movable contact, thus suppressing rattle and the like of the set knob. Meanwhile, a wide range of the dimensional tolerance when designing the parts of the electric apparatus helps improve the designing flexibility.

DETAILED DESCRIPTION OF THE INVENTION

Hereinafter, an embodiment of the present invention will be described with reference to FIGS. 1 through 6.

Embodiment

Figure 1:
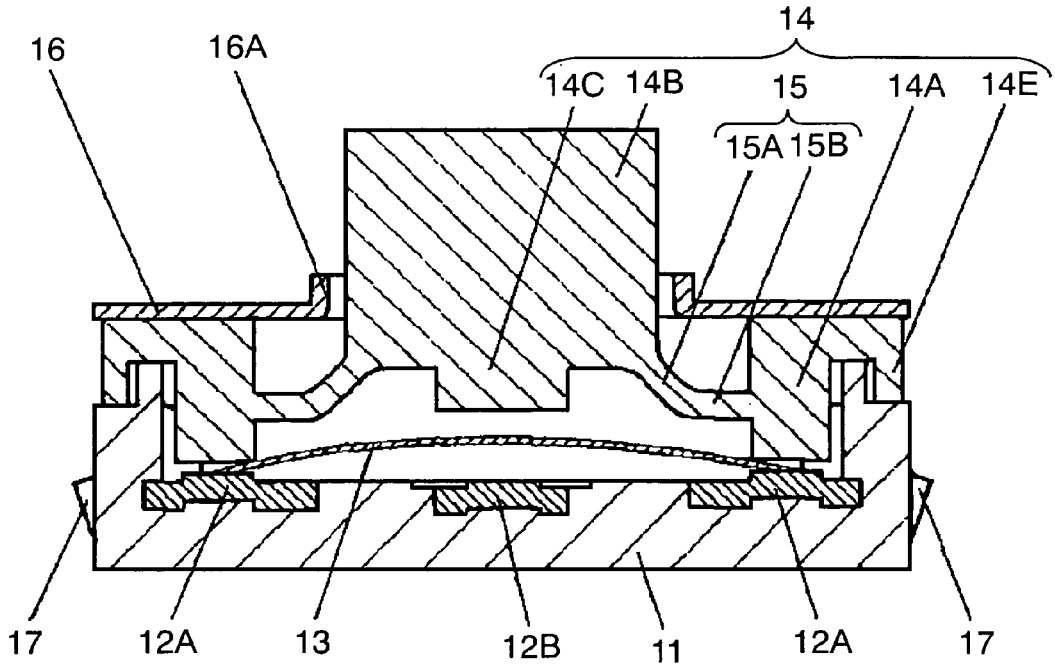
FIG. 1 is a sectional view of a push-on switch according to an embodiment of the present invention.

FIG. 1 is a sectional view of a push-on switch according to an embodiment of the present invention.

In FIG. 1, case 11 is a case made of insulating resin having a recess open at its top. The inner bottom surface of the recess is formed as a contact-arrangement part further concave with its round central part. Outer fixed contact 12A and central fixed contact 12B are disposed to be electrically independent of each other at the bottom outer circumference of the contact-arrangement part and its central position, respectively.

Movable contact 13 is made of a highly-conductive thin metal plate and is formed in an upwardly convex dome shape. The bottom end of the dome-shaped outer circumference is placed on outer fixed contact 12A in the contact-arrangement part. The bottom surface of the central top of movable contact 13 faces the above-mentioned central fixed contact 12B across a given clearance. Movement of movable contact 13 to the side is restricted by the step composing a round recess, which is to be a contact-arrangement part, for which detailed illustration is omitted. Elastic body 14 made of an elastomer is disposed above movable contact 13.

Figure 2:
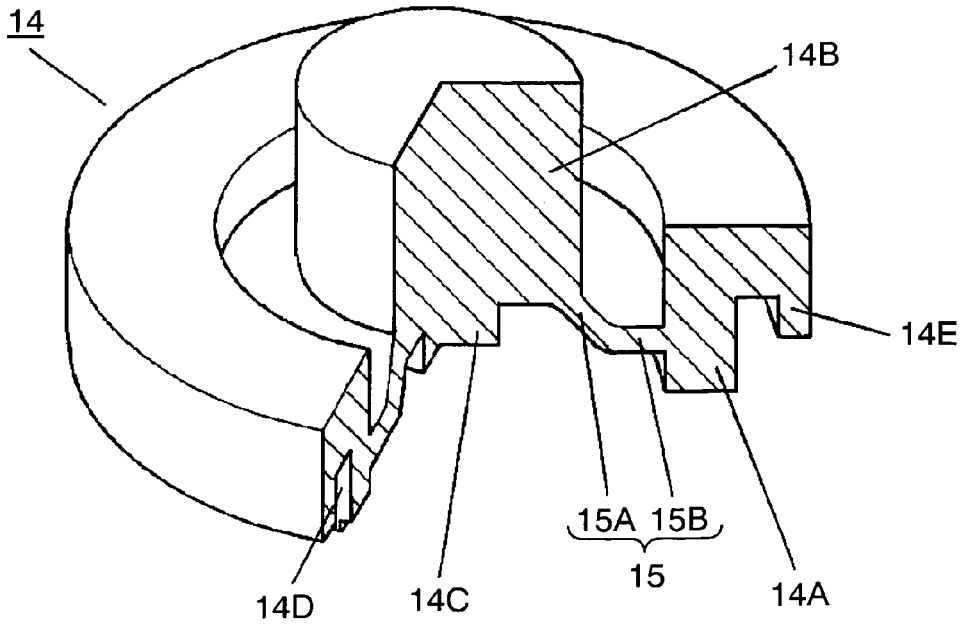
FIG. 2 is a partially sectional, perspective view of a power driver, which is a substantial part of the push-on switch.

FIG. 2 is a partially sectional, perspective view of a power driver, which is a substantial part of the push-on switch according to the embodiment of the present invention. As shown in FIG. 2, elastic body 14 is equipped with tubular periphery 14A with a diameter roughly identical to that of movable contact 13. Cylindrical part (engagement part) 14B with its top composing an operating part is movably connected to periphery 14A through thin-walled part 15, so that the cylindrical part 14B is movable up and down in the central hole of the periphery 14A. Still, the bottom end of above-mentioned periphery 14A is placed on the periphery of movable contact 13. The bottom end surface of the cylindrical part 14B is equipped with a small-diameter, downwardly-projecting pressing part 14C. Here, the respective parts of elastic body 14 are integrally formed.

The above-mentioned thin-walled part 15 is composed of conical part 15A with its bottom open, extended from the bottom of the outer circumference of cylindrical part 14B; and horizontal part 15B linking to the bottom end of the conical part 15A. Pressing part 14C of the bottom end of cylindrical part 14B supported by this thin-walled part 15 is retained at a position to face the top surface of the central top of movable contact 13, across a given clearance. Here, the angle and wall thickness of conical part 15A are set so as not to cause comfortableness upon inversion. Horizontal part 15B is formed parallel to the bottom surface of case 11, in a ring shape concentrically with the central axis of cylindrical part 14B as the center, from the top view.

As shown in FIG. 2, several grooves 14D crossing periphery 14A are provided in the bottom end of periphery 14A. This structure allows internal and external air in the space above movable contact 13 to circulate. Here, through-holes or the like, instead of grooves 14D, may be provided on periphery 14A so that internal and external air in the space above movable contact 13 circulates.

Retainer 14E, hook-shaped in the section view, is integrally formed on the outer circumference of periphery 14A of elastic body 14, and is hooked on the top end of the outer circumferential wall composing the recess of case 11. Here, the outer circumferential portion of retainer 14E is composed so as to stay within case 11 in the above-mentioned hooking state.

Cover 16 is a cover made of a metal plate, combined with the above-mentioned case 11 so as to cover the opening of case 11. Its central part has tubular part 16A formed at the periphery of its central round hole by an upward burring process. Cylindrical part 14B of the above-mentioned elastic body 14 projects upward through the central round hole of tubular part 16A.

Such an arrangement allows cylindrical part 14B, supported only by thin-walled part 15 in a non-operational state, to move up and down along the inner circumferential surface of tubular part 16A, thus reducing prying operations and the like. Here, instead of forming tubular part 16A with a metal plate, a tubular molded part may be integrally insert-molded at the end of the central hole of the metal plate, for example.

Cover 16 is assembled so as to slightly press down the top end surface of periphery 14A of elastic body 14 in a state of being combined with case 11, and thus periphery 14A is in a state of being slightly compressed. Movable contact 13 press-contacts outer fixed contact 12A owing to a force caused by the compression of periphery 14A, maintaining an electrically stable contact condition. Here, terminals 17 extend out of case 11 from outer fixed contact 12A and central fixed contact 12B, both disposed in the above-mentioned case 11, respectively.

A push-on switch according to the present invention is composed as mentioned above.

Next, the actions of a push-on switch according to the present invention and its operation force curve will be described.

Figure 3:
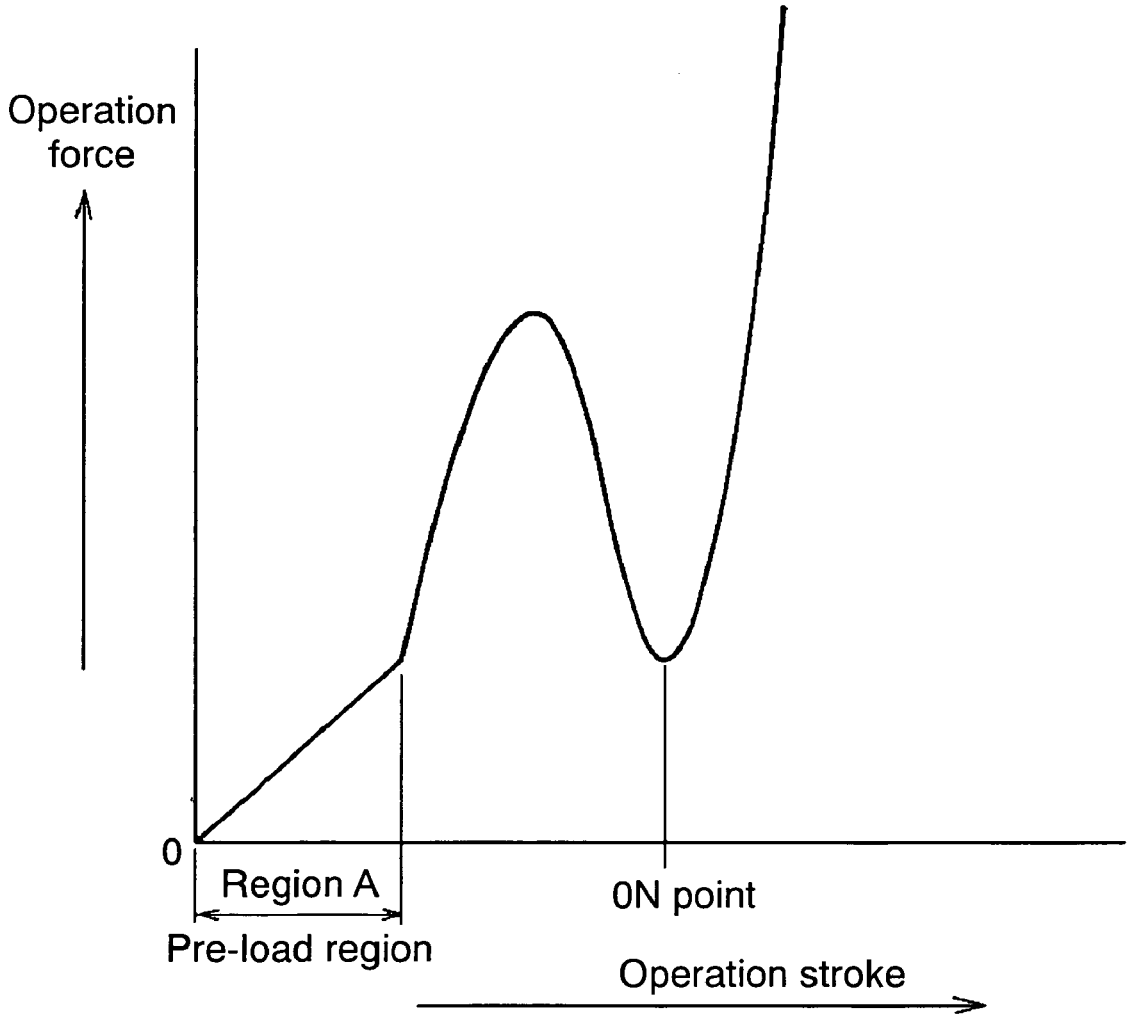
FIG. 3 is a figure showing an operation force curve of the push-on switch.
Figure 4:
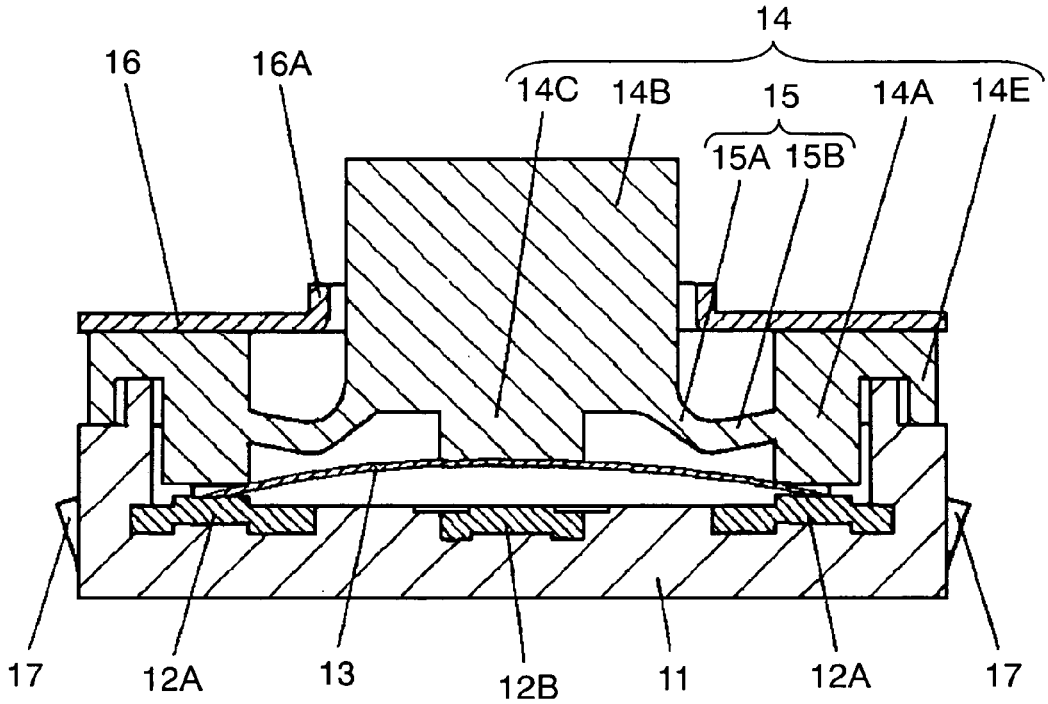
FIG. 4 is a sectional view of the push-on switch in operation.

FIG. 3 is a figure showing an operation force curve of the push-on switch according to the embodiment of the present invention. FIG. 4 is a sectional view of the push-on switch in operation, according to the embodiment of the present invention.

When cylindrical part 14B, projecting from cover 16, of elastic body 14 is pressed, the rising angle of conical part 15A from horizontal part 15B becomes slightly low, and at the same time, the central part of ring-shaped horizontal part 15B continues to bend downward. Then as shown in FIG. 4, the distance between the bottom end surface of pressing part 14C and the top surface of movable contact 13 decreases until they touch each other.

In this case, such a shape of thin-walled part 15 allows elastic body 14 to be formed simply and easily. In the above-mentioned actions in particular, the central portion of horizontal part 15B, which becomes the side of the connection with conical part 15A, moves down, and thin-walled part 15 of elastic body 14 can be made so that it continues to elastically bend.

The outer circumferential surface of cylindrical part 14B moves down along tubular part 16A of cover 16, and thus pressing part 14C touches movable contact 13 in accordance with the position of the central top of movable contact 13, with few prying actions or the like.

The above-mentioned actions are effective to contract the space above movable contact 13 and enclosed by the top surface of movable contact 13, tubular periphery 14A of elastic body 14, and the bottom surface of thin-walled part 15 connected to periphery 14A, so as to compress the air in the space as well. However, the construction that allows air to circulate through grooves 14D disposed on the bottom end of periphery 14A hardly influences an operation force or the like due to the air compression, thus stabilizing the above-mentioned actions.

In the actions so far, thin-walled part 15 in a so-called cantilevered state merely continues to bend without comfortableness when cylindrical part 14B moves. Therefore, the operation force is roughly proportional to the operation stroke in region A (pre-load region) in FIG. 3.

Here, the strength of the operation force can be set as appropriate by setting the shape of thin-walled part 15 or other methods. For example, a shape of conical part 15A with a high rising angle from horizontal part 15B requires a strong operation force to operate the switch. Further, horizontal part 15B may be inclined with its central portion and outer circumference vertically out of alignment, or both the above-mentioned structures may be combined.

Here, in region A shown in FIG. 3, that is to say, in the initial press-down distance, which refers to a distance until pressing part 14C of elastic body 14 contacts the top surface of movable contact 13, comfortableness does not occur. In a case in which elastic body 14 deviates with a weak force of approximately 0.3 N to 1 N, for example, and additionally in which the operation stroke, which is a moving distance of the elastic body 14, is set to approximately 0.5 mm to 0.6 mm, region A can be utilized as a pre-load region.

Figure 5:
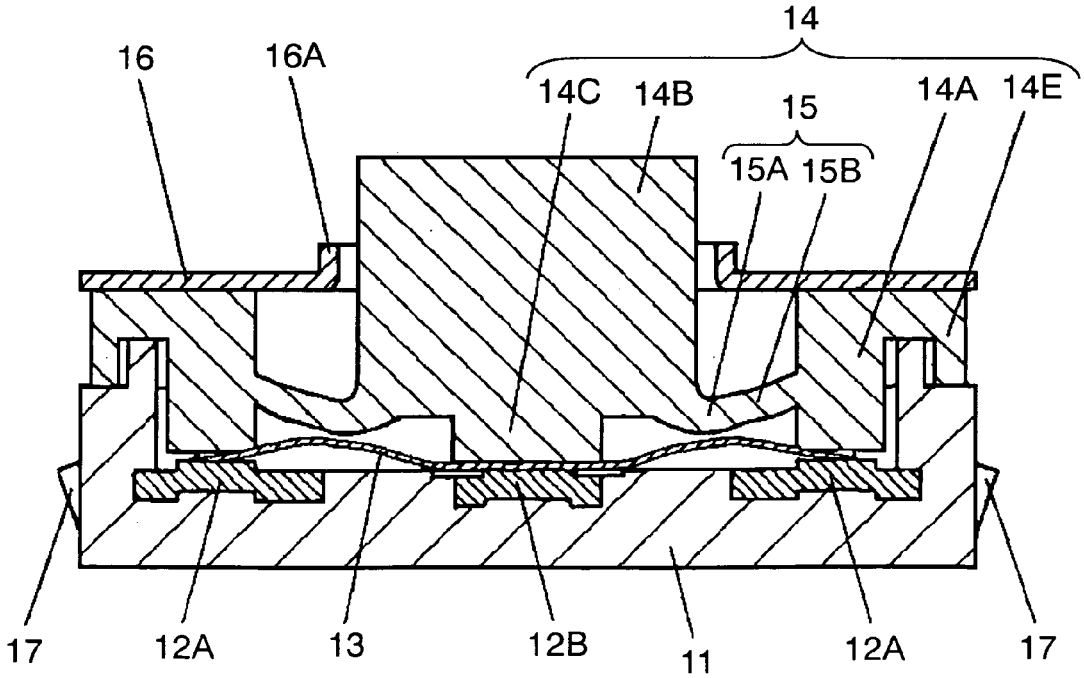
FIG. 5 is a sectional view of the push-on switch in operation.

FIG. 5 is a sectional view of the push-on switch in operation, according to the embodiment of the present invention. As shown in FIG. 5, when a pressing force is further applied to cylindrical part 14B, with pressing part 14C of elastic body 14 touching movable contact 13, pressing part 14C presses down and inverts movable contact 13. At this moment, movable contact 13 inverts with comfortableness. The central bottom surface of movable contact 13 contacts central fixed contact 12B disposed on the contact-arranged part of case 11, with an operation stroke at the ON point shown in FIG. 3. Then, central fixed contact 12B short-circuits with outer fixed contact 12A through movable contact 13, to enter a switch-on state.

Thin-walled part 15 deviates downward roughly linearly at the central portions of conical part 15A and horizontal part 15B. The force required for the deviation is added to an inversion action force of movable contact 13. If the maximum value of an inversion action force of movable contact 13 is set to a value roughly more than twice the maximum deformation force in region A, which is a pre-load region, a finger or the like used for operating the switch reliably feels comfortableness.

Here, even during the above-mentioned actions, cylindrical part 14B moves down with its tilt being restricted by tubular part 16A of cover 16, thus causing few prying operations or the like, and additionally the air in the space above movable contact 13 flows out through grooves 14D of periphery 14A, resulting in stable actions.

When a pressing force applied to cylindrical part 14B of elastic body 14 is released, movable contact 13 restores to its original state with comfortableness due to its own restorative force, and its bottom surface separates from central fixed contact 12B, entering the original switch-off state. Further, thin-walled part 15 of elastic body 14, having been bent, returns to the original shapes of horizontal part 15B and conical part 15A, due to its own restorative force. That is, as shown in FIG. 1, pressing part 14C returns to a state in which it is separated above movable contact 13 with a given clearance.

At this moment, the application force of thin-walled part 15 elastically bending provides a weak restorative force in the above-mentioned restorative action. However, as a result of external air flowing into the closed space above movable contact 13 through grooves 14D provided on tubular periphery 14A shown in FIG. 2, the restorative action is aided, resulting in a smooth and stable return action.

As mentioned above, a push-on switch according to an embodiment of the present invention is structured so that pressing part 14C of elastic body 14 faces movable contact 13 across a given distance, and an initial press-down distance, which refers to a distance until pressing part 14C contacts the top surface of movable contact 13 without comfortableness, can be secured. Therefore, the initial press-down distance can be utilized as a pre-load region.

Figure 6:
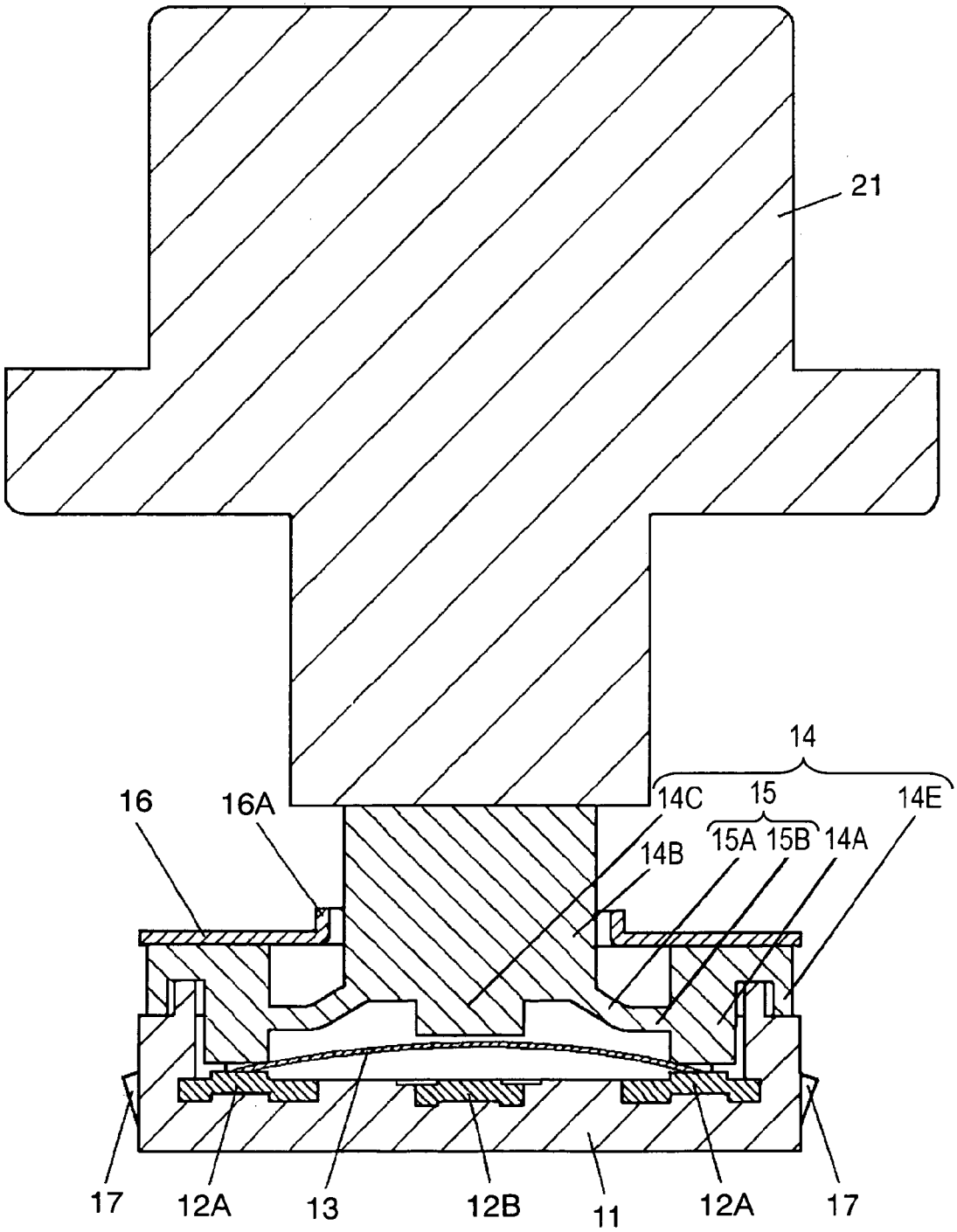
FIG. 6 is a sectional view of the push-on switch incorporated into an electric apparatus.
Figure 7:
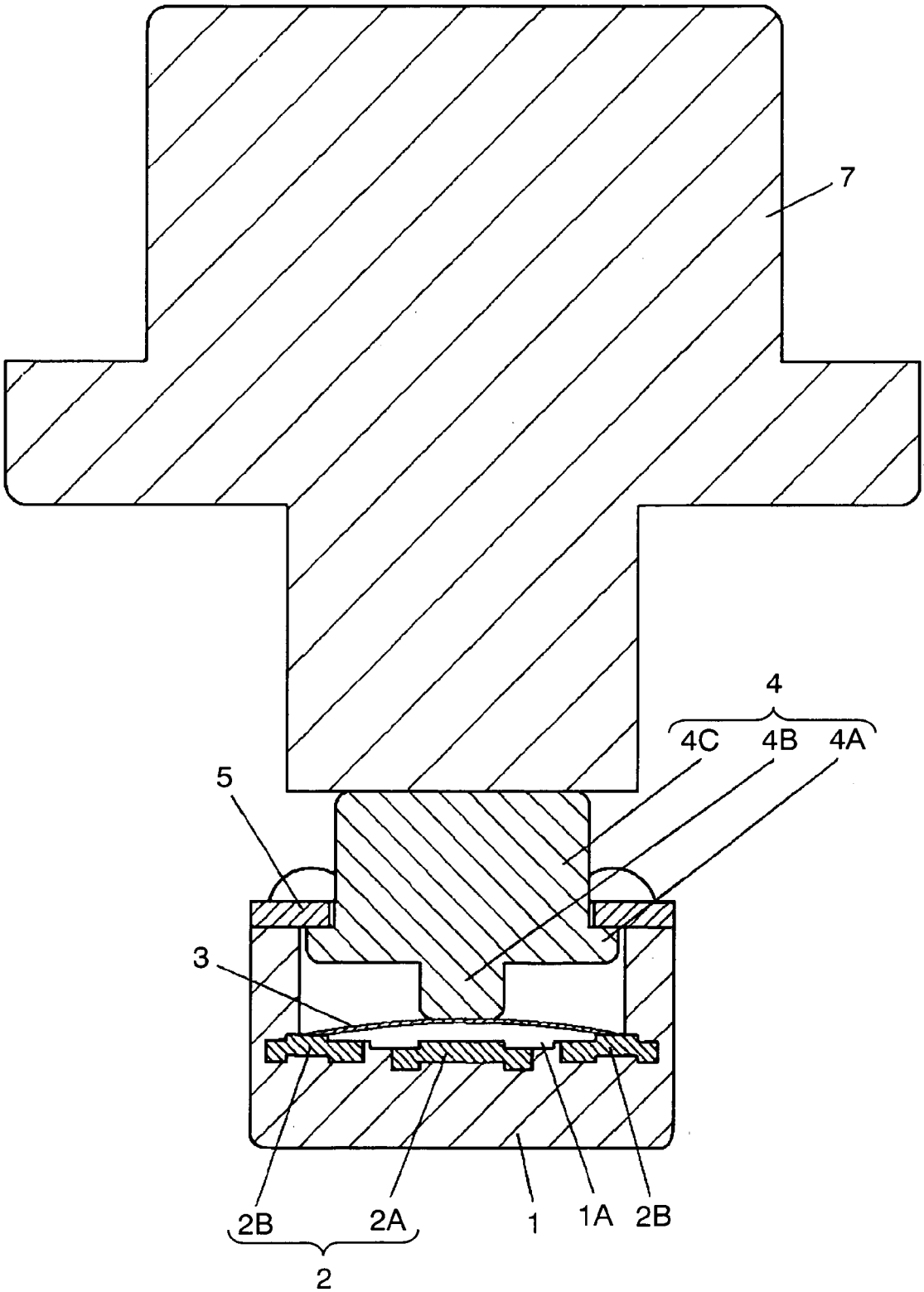
FIG. 7 (PRIOR ART)
FIG. 7 is a sectional view of the conventional push-on switch.

FIG. 6 is a sectional view of the push-on switch incorporated into an electric apparatus, according to the embodiment of the present invention. As shown in FIG. 6, when incorporating the push-on switch into an electric apparatus, set knob 21, which is an operation button in the electric apparatus that is movable up and down, is positioned with thin-walled part 15 of elastic body 14 slightly bent in region A, or a pre-load region, before disposing the push-on switch. This arrangement allows movable contact 13 to be maintained in a non-operational state, and suppresses rattle of set knob 21 owing to a reactive force from the above-mentioned thin-walled part 15. In this case, considering fit dimensions of set knob 21 into the cabinet, finish dimensions of set knob 21, and the like, set knob 21 preferably performs an initial press-down of cylindrical part 14B, aiming at the intermediate position of the operation stroke in region A.

In this way, in a push-on switch according to the present invention, even if composed of movable contact 13, dome-shaped with its short operation stroke, the push-on switch can be incorporated into an electric apparatus with set knob 21 combined, with a given pre-load applied to elastic body 14. Further, rattle and the like of set knob 21 can be suppressed while the range of the dimensional tolerance and the like when designing the parts of the electric apparatus are expanded to improve the designing flexibility.

What is claimed is:

1. A push-on switch comprising:

a case including a base portion and a peripheral side wall projecting from said base portion generally in a first direction, so as to form a recess opening in said first direction, said case being formed of insulating resin;

a plurality of electrically independent fixed contacts disposed on a surface of said base portion of said case that faces in said first direction, said fixed contacts including at least a first fixed contact and a second fixed contact;

a dome-shaped movable contact supported on said surface of said base portion and having a first portion non-movably contacting said first fixed contact, and a second portion movably supported for movement toward said second fixed contact in a second direction opposite said first direction;

an elastic body supported in said recess of said case, said elastic body including an engaging part having a pressing part facing in said second direction toward said second portion of said dome-shaped movable contact, said elastic body including a peripheral part supporting said elastic body with respect to said case, and said elastic body including a thin-walled part connecting between said peripheral part and said engaging part; and a cover mounted to said case and covering said recess of said case;

wherein said engaging part of said elastic body further has a force-receiving portion arranged to receive a pressing force directed generally in said second direction;

wherein said dome-shaped movable contact is arranged such that, in a normal, unpressed state, said second portion of said dome-shaped movable contact is spaced apart from said second fixed contact, and upon being pressed a given amount in said second direction, said second portion of said dome-shaped movable contact contacts said second fixed contact, so as to electrically connect said first and second fixed contacts; and wherein said thin-walled part of said elastic body includes a conical part that has a conical interior surface and a conical exterior surface and that, in a normal, unpressed state, extends from said engaging part of said elastic body generally in said second direction, and a horizontal part that, in a normal, unpressed state, connects between said conical part and said peripheral part in a direction generally perpendicular to said first and second directions, said elastic body being arranged so that, in a normal, unpressed state, said thin-walled part is unimpeded from allowing said engaging part to be movable in said first and second directions.

2. The push-on switch as claimed in claim 1, wherein said engaging part of said elastic body is constituted by a cylindrical part.

3. The push-on switch as claimed in claim 1, wherein said peripheral part of said elastic body is disposed on a peripheral portion of said dome-shaped movable contact.

4. The push-on switch as claimed in claim 3, wherein an enclosed space is defined by said movable contact and said elastic body, and said peripheral part of said elastic body has one of a groove and a through-hole for circulating internal air of the enclosed space with external air.

5. The push-on switch as claimed in claim 1, wherein said peripheral part, said engaging part, and said thin-walled part are all formed integrally as a single piece.

6. The push-on switch as claimed in claim 1, wherein said cover has a hole formed therein through which said engaging part of said elastic body projects.

7. The push-on switch as claimed in claim 6, wherein said cover includes a tubular part projecting from a periphery of said hole in said first direction so as to surround said engaging part of said elastic body.

8. The push-on switch as claimed in claim 1, wherein said cover is arranged so as to press said peripheral part of said elastic body in said second direction in order to press said first portion of said dome-shaped movable contact against said first fixed contact.

* * * * *

UNITED STATES PATENT AND TRADEMARK OFFICE

CERTIFICATE OF CORRECTION

PATENT NO. : 7,109,431 B2
APPLICATION NO. : 11/250547
DATED : September 19, 2006
INVENTOR(S) : Yasunori Yanai et al.

It is certified that error appears in the above-identified patent and that said Letters Patent is hereby corrected as shown below:

On the cover page,

In item (74) Attorney, Agent, or Firm:

"Weneroth, Lind & Ponack, L.L.P." should read --Wenderoth, Lind & Ponack, L.L.P.--.

Signed and Sealed this

Twenty-sixth Day of December, 2006

JON W. DUDAS
*Director of the United States Patent and Trademark Office*